US006168260B1

(12) United States Patent
Yanagi et al.

(10) Patent No.: US 6,168,260 B1
(45) Date of Patent: Jan. 2, 2001

(54) RECORDING APPARATUS

(75) Inventors: Haruyuki Yanagi, Machida; Hideaki Kawakami, Yokohama, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/038,993

(22) Filed: Mar. 12, 1998

(30) Foreign Application Priority Data

Mar. 13, 1997 (JP) ..... 9-059349
Mar. 9, 1998 (JP) ..... 10-056622

(51) Int. Cl.[7] ..... B41J 23/00
(52) U.S. Cl. ..... 347/37; 347/8
(58) Field of Search ..... 347/30, 32, 37, 347/8

(56) References Cited

U.S. PATENT DOCUMENTS 5,475,404 * 12/1995 Takahashi et al. ..... 347/23
5,751,301 * 5/1998 Saikawa et al. ..... 347/32

FOREIGN PATENT DOCUMENTS 2 318 947 10/1974 (DE) .
0 313 204 4/1989 (EP) .
0 526 209 2/1993 (EP) .
0 591 844 4/1994 (EP) .

* cited by examiner

*Primary Examiner*—N. Le
*Assistant Examiner*—Shihwon Hsieh
(74) *Attorney, Agent, or Firm*—Fitzpatrick, Cella, Harper & Scinto

(57) ABSTRACT

A recording apparatus for performing recording on a recording medium by use of a recording head, the recording apparatus comprises a carriage for reciprocal scanning of the recording head for recording on the recording medium, a guide for guiding the carriage in directions of the reciprocal scanning, and a positioning member and a press member located opposite to each other with the guide in between on the carriage, wherein the press member is not pressed against the guide in a region except for a predetermined region in a reciprocal scan region of the carriage and the press member is pressed against the guide in the predetermined region.

18 Claims, 15 Drawing Sheets

RECORDING APPARATUS

BACKGROUND OF THE INVENTION

1. Field of the Invention

The present invention relates to a recording apparatus of the serial type in which a carriage holding a recording head undergoes the main scanning in a direction perpendicular to a conveying direction of a recording medium (the sub-scanning direction).

2. Related Background Art

The recording apparatus having functions of printer, copier, facsimile device, or the like, or the recording apparatus used as an output device of workstation or composite electronic equipment including a computer, a word processor, or the like is constructed so as to record an image on a recording material (recording medium) such as paper or a plastic thin film, based on image information. These recording apparatus can be classified based on their recording methods, for example, into the ink Jet type, the wire dot type, the thermal type, the laser beam type, and so on.

In the recording apparatus of the serial type adopting the serial scan method for performing the main scanning in the direction perpendicular to the conveying direction of the recording material (the sub-scanning direction), an image is recorded on the entire recording material by repeating such operation that an image for a line is recorded (or mainly scanned) by recording means mounted on a carriage arranged to move along the recording material, the recording material is fed by a predetermined amount (or conveyed by a pitch) after completion of the recording in one line, and thereafter an image for a next line is recorded (or mainly scanned) on the recording material after being stopped again.

An example of the conventional serial type recording apparatus is one in which the carriage carrying the recording head in a detachable state is slidably mounted on a guide shaft and a guide rail provided parallel to each other. The carriage is coupled with a part of a timing belt stretched between a pulley fixed to an output shaft of a carriage motor and an idle pulley rotatably supported, and the recording head is reciprocated by forward rotation and backward rotation of the carriage motor. The carriage is provided with a gap distance adjusting portion for adjustment of a gap between the recording head and the recording material.

This gap distance adjusting portion will be described referring to FIG. 15. FIG. 15 is a drawing for explaining the gap distance adjusting portion of the carriage in the conventional serial type recording apparatus. The view of the carriage 1050 shown in FIG. 15 corresponds to the top plan view of carriage 50 of FIG. 1 that illustrates an embodiment of the present invention described hereinafter.

As shown in FIG. 15, the gap distance adjusting portion is provided in the upper part of carriage 1050 and is composed of an adjusting lever 1581, a press lever 1582, a press spring 1583, and a top cover 1584.

The adjusting lever 1581 is pivoted by putting a pin thereof in a hole provided in the carriage 1050. The adjusting lever 1581 has polygonal slide faces 1585 in different distances from the center of rotation of the adjusting lever 1581, according to the number of gap distance positions. The press lever 1582 is pivoted about a pin provided on the carriage 1050 and urges a slide face 1585 of the adjusting lever 1581 against the guide rail 1082 by the press spring 1583; for example, describing with FIG. 1, it biases the carriage in a rotational direction so that the top part of carriage 50 may be displaced to this side about the guide shaft 81. When a slide face 1585 of the adjusting lever 1581 is switched to another, the carriage rotates about the guide shaft 1081, thus achieving change in the gap distance. The top cover 1584 is fixed by claws formed on the both sides of the carriage 1050, thereby holding the adjusting lever 1581, the press lever 1582, and so on. The adjusting lever 1581 has elasticity and a projection is formed at the tip thereof. This projection is fitted in either one of plural grooves formed at predetermined positions in the top cover 1584 to fix the adjusting lever 1581, thus establishing a gap of a predetermined distance.

Further, an ink jet recording apparatus is provided with a recovery mechanism for performing a recovery process for the recording head mounted on the carriage, at one end of the reciprocal scan range of the carriage. The recovery mechanism has a cap for removing viscosity-increased ink in the recording head and for protecting the recording head during the non-recording period. With the carriage in the structure of FIG. 15 contact pressure was achieved between the recording head and the cap on the occasion of contact by utilizing the urging force of the press lever against the guide rail. The gap adjusting mechanism of this structure has an advantage of permitting easy gap adjustment by the simple structure and an advantage of permitting execution of a good recovery process of the recording head, because the contact pressure to the cap is obtained by use of the urging force of urging means.

In recent years, remarkable progress is made in improvement in the quality of an image and further development is under way to decrease in the diameter of dots of color recording image, increase in multiple gradation levels, and so on. Under such circumstances, the structure of the carriage in the conventional recording apparatus as described above had such a drawback that the urging force for urging the cap against the recording head also acted on the guide rail during the scan of the carriage and thus force to twist the carriage, i.e., force to rotate the carriage in the direction of the arrow about the center of rotation at the contact portion between the guide rail 1082 and the slide face 1585 as in FIG. 15, acted so as to exert a great load on the scan of the carriage. This was a hindrance against enhancement of the accuracy of recording position and against improvement in durability, for example, from the reason that abrasion would proceed at the sliding portion against the guide rail during long-term use or the like so as to degrade the sliding property and in turn cause stick-slip.

SUMMARY OF THE INVENTION

An object of the present invention is to provide a recording apparatus in which an urging force for rotationally urging a carriage is made to act between the carriage and a guide member for guiding movement of the carriage only in a predetermined region in a moving region of the carriage, for solving the above problem.

Another object of the present invention is to provide a recording apparatus in which the urging force for rotationally urging the carriage is made to act between the carriage and the guide member for guiding movement of the carriage only in the predetermined region in the moving region of the carriage, whereby the carriage can be urged and displaced in the predetermined region while enhancing the accuracy of recording position and the durability in a region except for the predetermined region.

Another object of the present invention is to provide an ink jet recording apparatus in which the urging force on the cap is given during the nonrecording period whereas no torque acts on the carriage during the recording scanning of the carriage, thereby enhancing the accuracy of recording position and the durability.

Still another object of the present invention is to provide a recording apparatus having a carriage for realizing reciprocal scanning of a recording head for recording in a recording medium, guide means for guiding the carriage in reciprocal scan directions, and a positioning member and a press member placed opposite to each other with the guide means in between on the carriage, wherein the press member is not pressed against the guide means in a region except for a predetermined region in a reciprocal scan region of the carriage but is pressed against the guide means in the predetermined region.

DETAILED DESCRIPTION OF PREFERRED EMBODIMENTS

The recording apparatus as embodiments according to the present invention will be described by reference to the drawings.

First Embodiment

Figure 1:
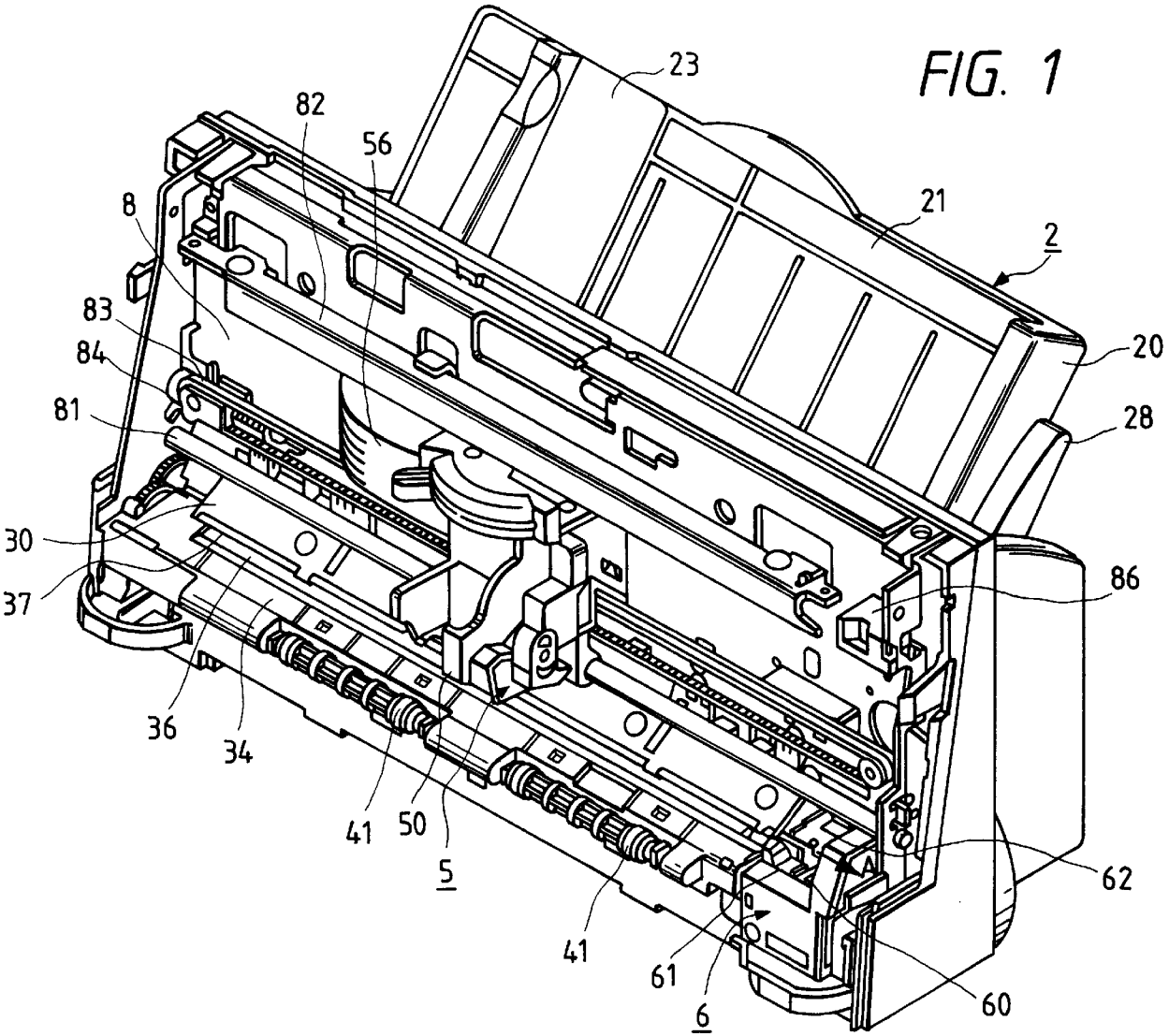
FIG. 1 is a perspective view of the first embodiment of the recording apparatus as an embodiment according to the present invention.
Figure 2:
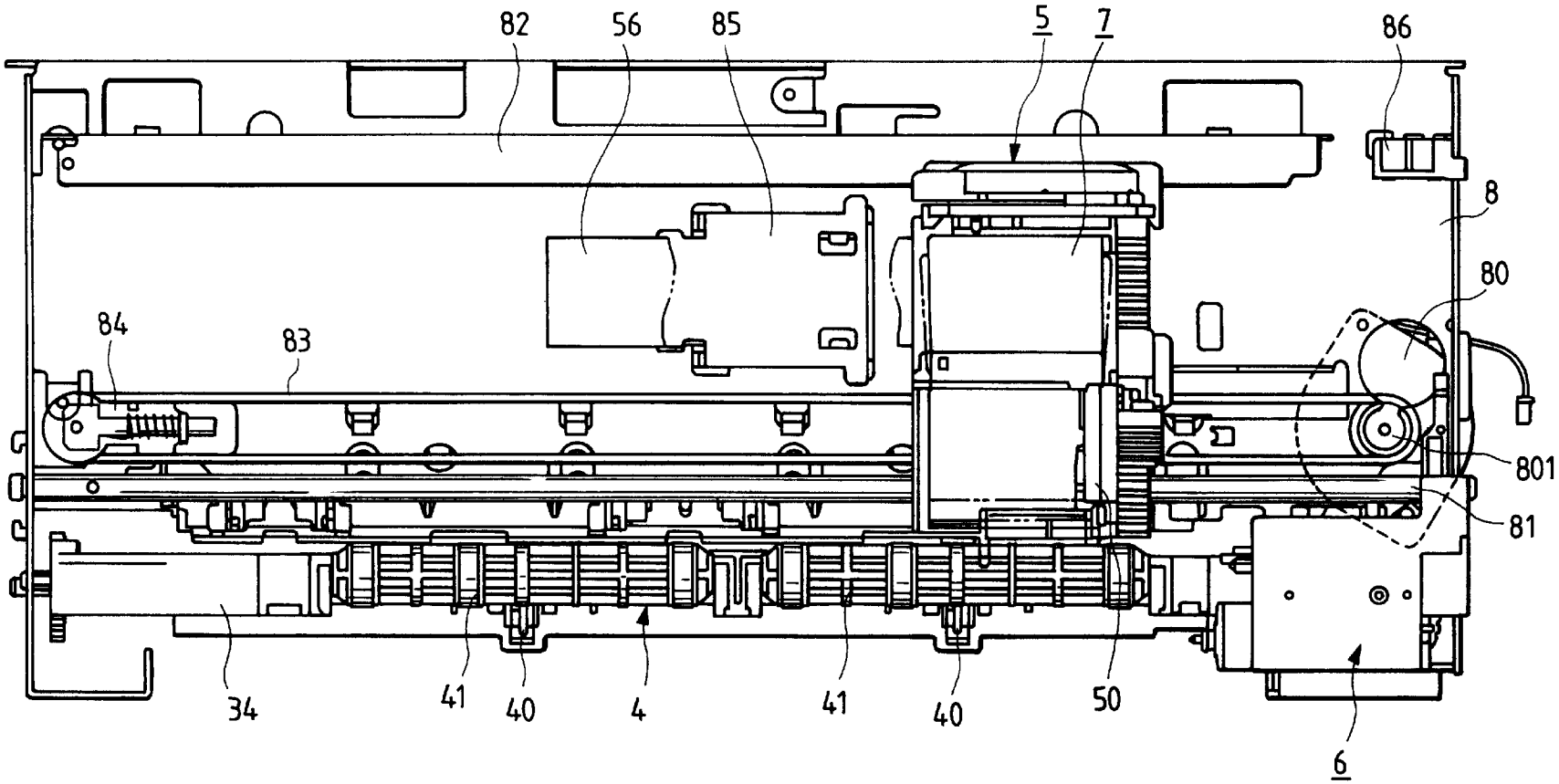
FIG. 2 is a front view of the recording apparatus shown in FIG. 1.
Figure 3:
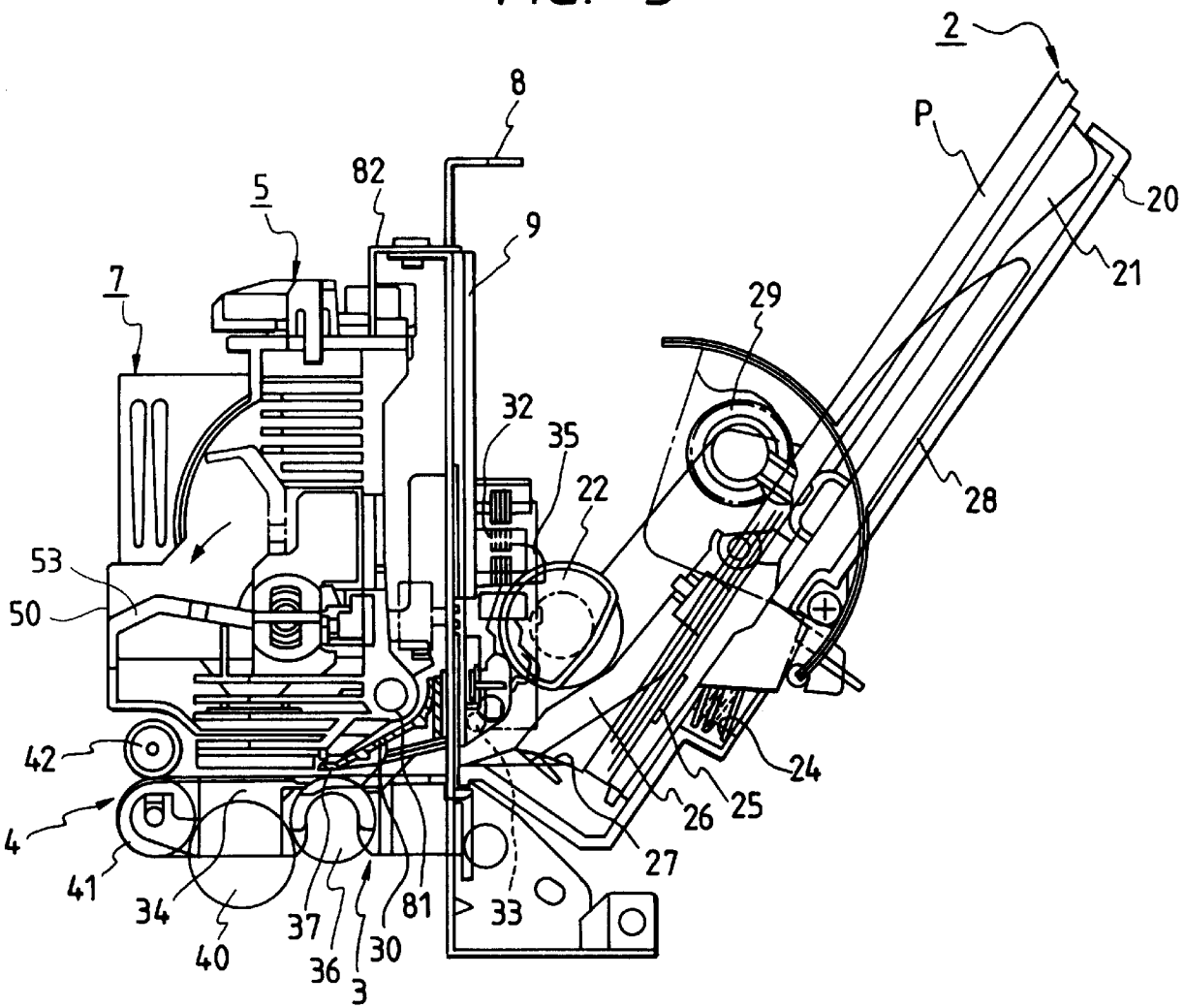
FIG. 3 is a cross-sectional view of the configuration of the recording apparatus shown in FIG. 1.

FIG. 1 is a perspective view of the first embodiment of the recording apparatus according to the present invention. FIG. 2 is a front view of the recording apparatus shown in FIG. 1 and FIG. 3 is a cross-sectional view to show the structure of the recording apparatus shown in FIG. 1.

The recording apparatus of the present embodiment is an ink jet recording apparatus of the serial type, which is composed of a carriage portion 5 for detachably carrying a recording head 7; a sheet supply portion 2, a sheet feed portion 3, and a sheet discharge portion 4 for conveying a sheet medium P being a recording material; and a recovery process portion 7 for maintaining and recovering the ink ejection performance of the recording head 7 on the carriage portion 5. These portions will be described briefly referring to FIG. 1 to FIG. 3.

(A) Sheet supply portion

The sheet supply portion 2 is constructed in such a configuration that a press plate 21 for carrying sheet media P and a feed roller 22 for supplying a sheet medium P are mounted on a base 20. The press plate 21 is provided with a movable side guide 23 which is arranged to be movable in directions along the width of the recording material and which restricts the loading position of the sheet media P. The press plate 21 is rotatable about a rotational shaft connected to the base 20 and is urged against the feed roller 22 by press plate spring 24. The contact between the press plate 21 and the feed roller 22 by the press plate spring 24 can be released by release cam 29. Attached to a portion of the press plate 21 opposite to the feed roller 22 is a separation pad 25 made of a material with a large coefficient of friction, such as artificial leather, for preventing a feed of multiple sheet media P. Further, the base 20 is provided with a separation claw 26 for separating a sheet medium P from the others while covering the lower edge corner of the sheet media P. For separating materials that do not allow use of the separating claw 26, such as thick sheets, a bank 27 is integrally molded with the base 20, and a switch lever 28 is provided for effecting changeover between a plain paper position to activate the separating claw 26 and a thick paper position to deactivate the separating claw 26.

In the above configuration, the release cam 29 pushes the press plate 21 down to a predetermined position in the standby state. This releases the contact between the press plate 21 and the feed roller 22. When in this state driving force caused by rotation of conveying roller 36 is transmitted through gears or the like to the feed roller 22 and to the release cam 29, the release cam 29 leaves the press plate 21 to allow the press plate 21 to move up, so that the feed roller 22 comes into contact with the sheet medium P. Then the sheet media P are picked up one by one with rotation of the feed roller 22, thus starting the feed of sheets. The sheet media P are separated one by one by the separation claw 26 to be fed to the sheet feed portion 3. The feed roller 22 and release cam 29 rotate until the sheet medium P is fed to the sheet feed portion 3. Thereafter, the contact between the recording sheet P and the feed roller 22 is again released so as to be in the standby state and the driving force from the conveying roller 36 is turned off.

(B) Sheet feed portion

The sheet feed portion 3 has the conveying roller 36 for conveying the sheet medium P and a PE sensor 32 for detecting the leading edge and the trailing edge of the sheet medium P. The conveying roller 36 is in contact with a pinch roller 37 driven thereby. The pinch roller 37 is held by pinch roller guide 30 and the pinch roller 37 is urged against the conveying roller 36 by urging force of a pinch roller spring (not illustrated), thereby generating conveying force of sheet medium P. Further, an upper guide 33 and a platen 34 for guiding the sheet medium P are placed at an entrance of the sheet feed portion 3 to which the sheet medium P is conveyed.

The upper guide 33 is provided with PE sensor lever 35 for transmitting detection of the leading edge and trailing edge of sheet P to the PE sensor 32. The carriage portion 5 described below is located on the downstream side in the sheet conveying direction of the conveying roller 36 and the recording head 7 for ejecting ink, based on image information, is detachably mounted on this carriage portion 5.

In the above configuration the sheet medium P sent to the sheet feed portion 3 is guided by the platen 34, pinch roller guide 30, and upper guide 33 to be sent to a roller pair of the conveying roller 36 and pinch roller 37. At this time the PE sensor lever 35 detects the leading edge of the sheet medium P being conveyed thereto, thereby finding a print position of the sheet medium P. The sheet medium P is conveyed on the platen 34 while the roller pair 36, 37 is rotated by an LF motor not illustrated.

The recording head 7 of the present embodiment is an ink jet recording head incorporated with an ink tank and being easy to replace, but it may be of a separate form composed of a recording head section and an ink tank section, or of a form in which only the recording head section is mounted on the carriage but the ink tank is not mounted on the carriage (i.e., the ink tank is mounted at a proper position in the housing of the apparatus body). This recording head 7 is arranged to be capable of supplying heat to ink by a heater or the like. This heat film-boils the ink and the ink is ejected from the recording head 7 by pressure change caused by growth or contraction of a bubble formed by the film boiling, thereby forming an image on the sheet medium P. The recording head 7 may also be one having electromechanical transducers such as piezoelectric devices and ejecting the ink by use of energy generated by the transducers.

In the above configuration, before the formation of image on the sheet medium P, the roller pair 36, 37 conveys the sheet medium P to a row position (a position in the conveying direction of sheet medium P) for formation of image and the carriage motor 80 moves the carriage 50 to a column position (a position in the direction perpendicular to the conveying direction of sheet medium P) for formation of image, thereby bringing the recording head 7 to the image forming position. After that, the ink is ejected from the recording head 7 toward the sheet medium P by signals from electric board 9, thereby forming an image thereon.

(C) Sheet discharge portion

In the sheet discharge portion 4, a transmission roller 40 is in contact with the conveying roller 36 and the transmission roller 40 is further in contact with discharge roller 41. Therefore, the driving force of the conveying roller 36 is transmitted through the transmission roller 40 to the discharge roller 41. A spur 42 capable of rotating following the discharge roller 41 is in contact with the discharge roller 41. In the above configuration, the sheet medium P on which the image is formed in the carriage portion 5 is nipped by the discharge roller 41 and the spur 42 and is conveyed to be discharged onto a discharge tray or the like not illustrated.

(D) Recovery process portion

The recovery process portion 6 is composed of a pump 60 for performing an ejection recovery process of the recording head 7, a cap 61 for preventing the ink in ink ejection ports of the recording head 7 from drying up, for protecting the recording head 7, and for capping the recording head 7 in order to suck the viscosity-increased ink or the like in the recording head to remove it therefrom, during the non-recording period (during the non-recording operation), and a drive switch arm 62 for switching the driving force from the conveying roller 36 to the sheet supply portion 2 or to the pump 60. Since the drive switch arm 62 fixes a planetary gear (not illustrated), which is arranged to rotate about the axis of conveying roller 36, at a predetermined position during periods except for the sheet supply and the ejection recovery process of the recording head 7, the driving force of the conveying roller 36 is not transmitted to the sheet supply portion 2 or the pump 60 during those periods. When movement of the carriage 50 described below moves the drive switch arm 62 in the direction of arrow A in FIG. 1, the planetary gear becomes free, so that the planetary gear will move depending upon the forward rotation or the backward rotation of the conveying roller 36; the driving force is transmitted to the sheet supply portion 2 with the forward rotation of the conveying roller 36, whereas the driving force is transmitted to the pump 60 with the backward rotation.

(E) Carriage portion

The carriage portion 5 has a carriage 50 on which the recording head 7 is detachably loaded. The carriage 50 is fitted on guide shaft 81 and guide rail 82 mounted in parallel to each other on chassis 8 so as to be slidable in directions perpendicular to the conveying direction of sheet medium P. The carriage 50 is coupled with a portion of timing belt 83 stretched between a pulley 801 fixed to an output shaft of carriage motor 80 fixed to the chassis 8 and an idle pulley 84 journaled in a freely rotatable state, and the carriage 50 is arranged to be reciprocated by the driving force of carriage motor 80. Further, the carriage 50 is provided with flexible board 56 for transmitting electric signals from the electric board 9 to the recording head 7.

The recording head 7 is of a cartridge type in which a nozzle portion 70 for ejecting the ink is incorporated with an ink tank 73 for retaining the ink to be supplied to the nozzle portion 70, as shown in FIGS. 14A–14D. The nozzle portion 70 and ink tank 73 are fixed each to base plate 72. The detailed structure of the recording head 7 will be described as the occasion may demand.

In the above configuration, when an image is formed on the sheet medium P, the conveying roller 36 and pinch roller 37 convey the sheet medium P to the row position (the position in the conveying direction of the sheet medium P) for formation of image and the carriage motor 80 moves the carriage 50 to the column position (the position in the direction perpendicular to the conveying direction of sheet medium P) for formation of image, whereby the recording head 7 is opposed to the image forming position. After that, the ink is ejected from the recording head 7 toward the sheet medium P by signals from the electric board 9, thereby forming the image.

Next, the main portions of the carriage portion 5 will be described in detail.

Figure 4B:
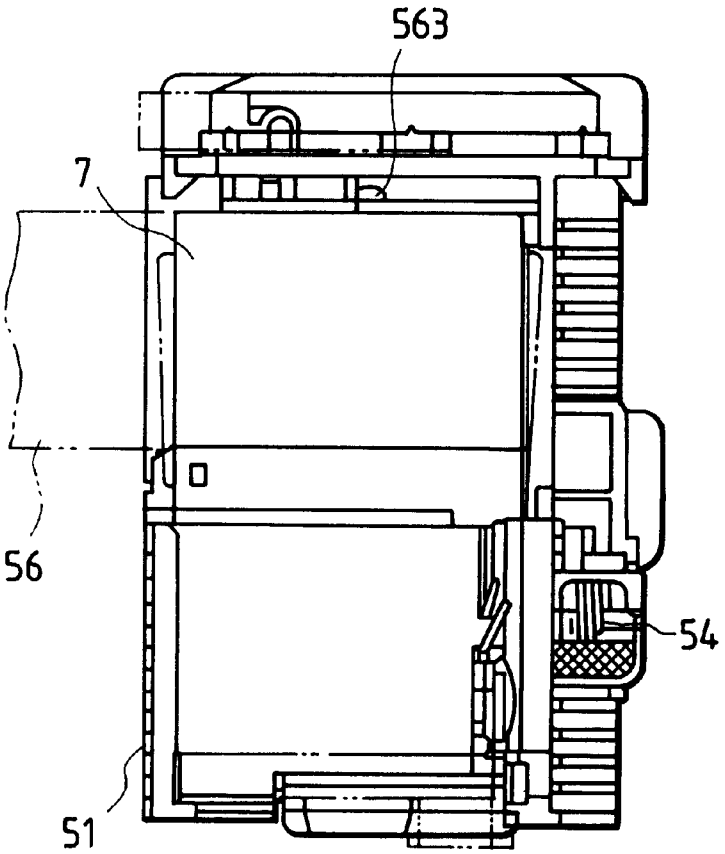
FIG. 4A and FIG. 4B are front views of a carriage portion of the recording apparatus shown in FIG. 1.
Figure 4A:
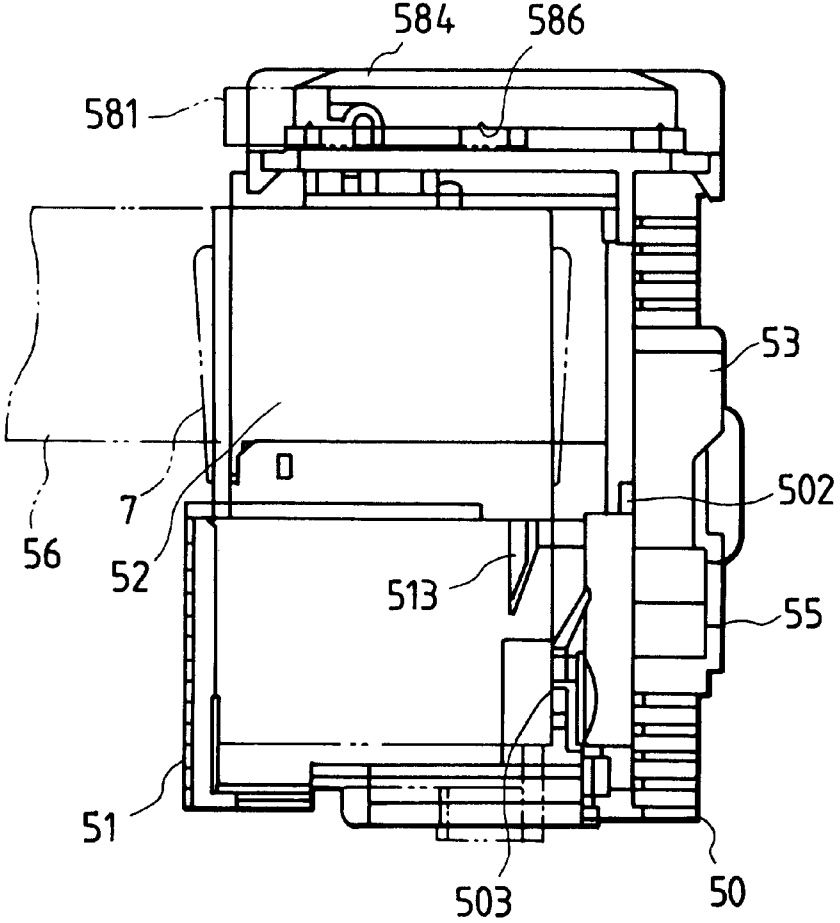
Figure 5:
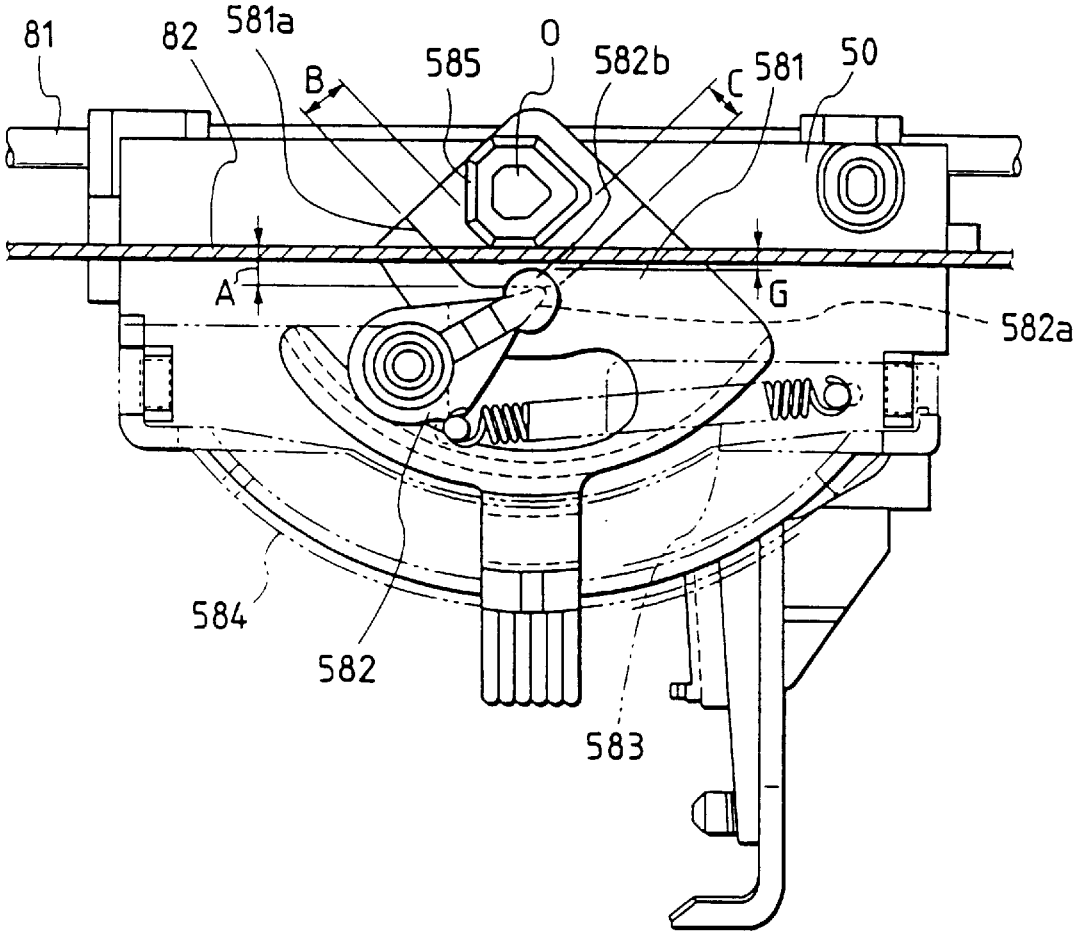
FIG. 5 is a plan view of the carriage portion of the recording apparatus shown in FIG. 1.

The carriage portion 5 is constructed in the form of a unit where the components thereof are mounted on the carriage 50. FIGS. 4A and 4B are front views of the carriage portion 5, FIG. 5 is a plan view of the carriage portion 5, FIG. 6 a structural drawing of a contact portion etc. of the carriage portion 5, and FIGS. 7A and 7B are a plan view and a front view, respectively, of a head holder 51 which is a main part of a mounting/dismounting mechanism of the recording head 7.

As shown in FIGS. 4A, 4B to FIGS. 7A, 7B, the carriage 50 has the head holder 51 for holding the recording head 7. The head holder 51 is arranged to slide horizontally along guide 501 provided on the carriage 50. The head holder 51 is provided with a guide portion 511 for guiding the recording head 7, and a pressing portion 512 for pressing the recording head 7 against contact surface 503 and three positioning faces 504 of side plate 502 vertically standing on the carriage 50. The positioning faces of the side plate 502 of the carriage are located at three positions. The two of them are located on the base plate 72 near the nozzle portion 70 of the recording head 7 and the remaining one on the upper part of the ink tank 73 of the recording head 7. The contact surface 503 between the recording head 7 and the carriage 50 is arranged to be located inside a triangle formed by the three positioning faces 504. The pressing position of the pressing portion 512 of the head holder 51 is also located inside this triangle.

A guide arm 513 is provided at an opposite position to the pressing portion 512 of the head holder 51, so that this guide arm 513 acts to the recording head 7 when the recording head 7 is taken off from the contact surface 503. The side plate 502 of the carriage 50 has a rib 509 also serving as a guide during mounting or dismounting of the head 7, thus protecting and shielding the contact portion 561 etc. of the flexible board 56 described hereinafter.

Figure 14A:
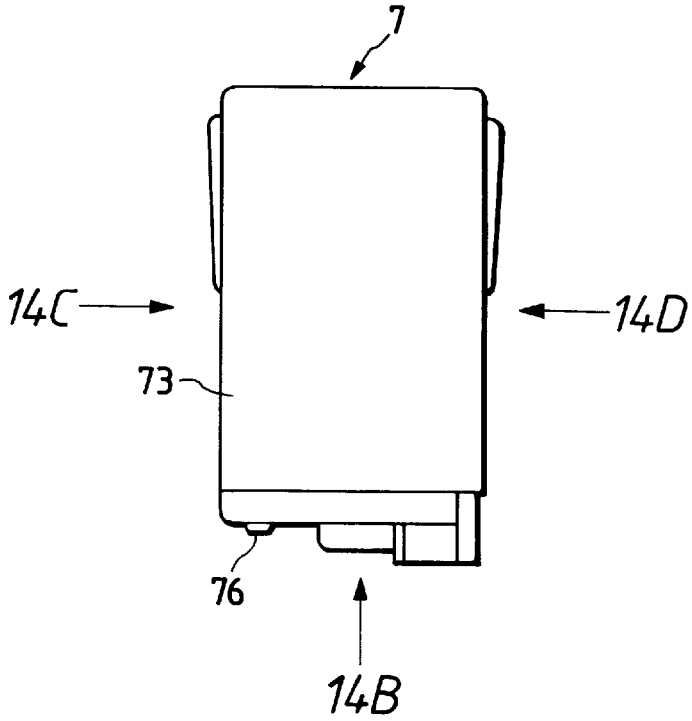
FIG. 14A, FIG. 14B, FIG. 14C, and FIG. 14D are a front view, a bottom view, and side views of the recording head.
Figure 14B:
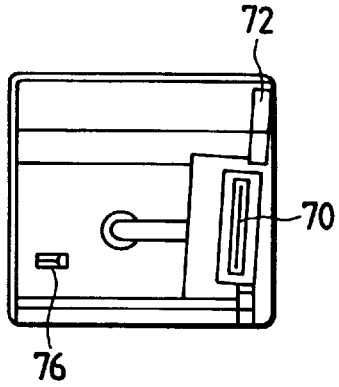
Figure 14C:
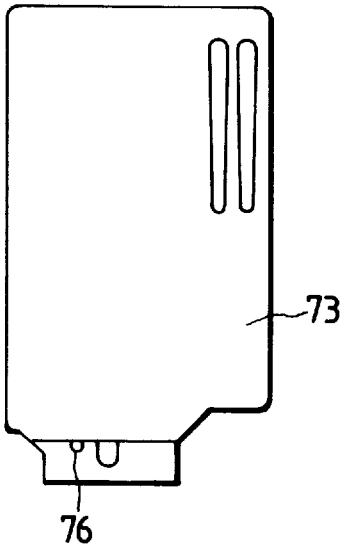
Figure 14D:
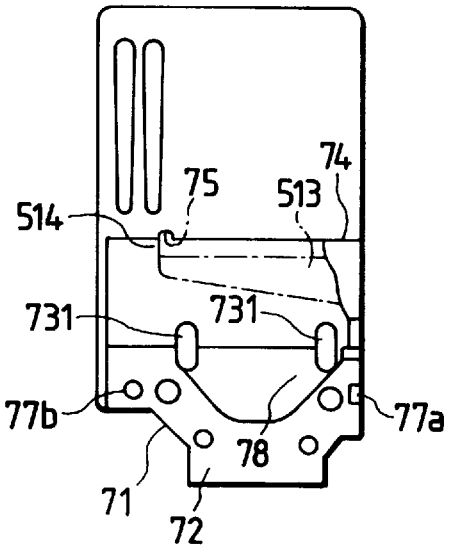

The recording head 7 is provided with a guide 74 on the side face of the ink tank 73 as shown in FIG. 14D, so that it can be mounted along the top surface of the guide arm 513. At a predetermined position, where the recording head 7 is mounted, the guide 74 of the recording head 7 is provided with a depression 75 and the head holder 51 is provided with a projection 514 as restricting means at a corresponding position thereto. Further, the bottom surface of the recording head 7 has a projection 76 and the head holder 51 has a depression 515 corresponding to the depression 76 in a corresponding receiving portion. This prevents the nozzle portion 70 from hitting the platen 34 etc. when the head 7 is mounted, and thus prevents the recording head 7 from being damaged. This configuration achieves the click feeling upon mounting, thus improving the mount feeling. The catch of the projection 514 of the head holder 51 can prevent the recording head 7 from dropping this side during mounting or dismounting of the recording head 7 and can eliminate the unstable feeling such as positional deviation after mounting.

A hook lever 53 is mounted in a rotatable state on the side plate 502 of the carriage 50. A contact spring 54 is provided at the center of rotation of the hook lever 53 to urge the hook lever 53 in the direction of the arrow shown in FIG. 3. A hook cover 55 is attached so as to cover the hook lever 53, thereby keeping the hook lever 53 from slipping off from the carriage 50. As shown in FIGS. 7A and 7B, the hook lever 53 and head holder 51 have cams 516, 531 contacting each other, and the head holder 51 is arranged to move horizontally with rotation of the hook lever 53. The urging force of the contact spring 54 is transmitted through the hook lever 53 to act as a pressing force against the recording head 7 on the head holder 51.

Figure 6:
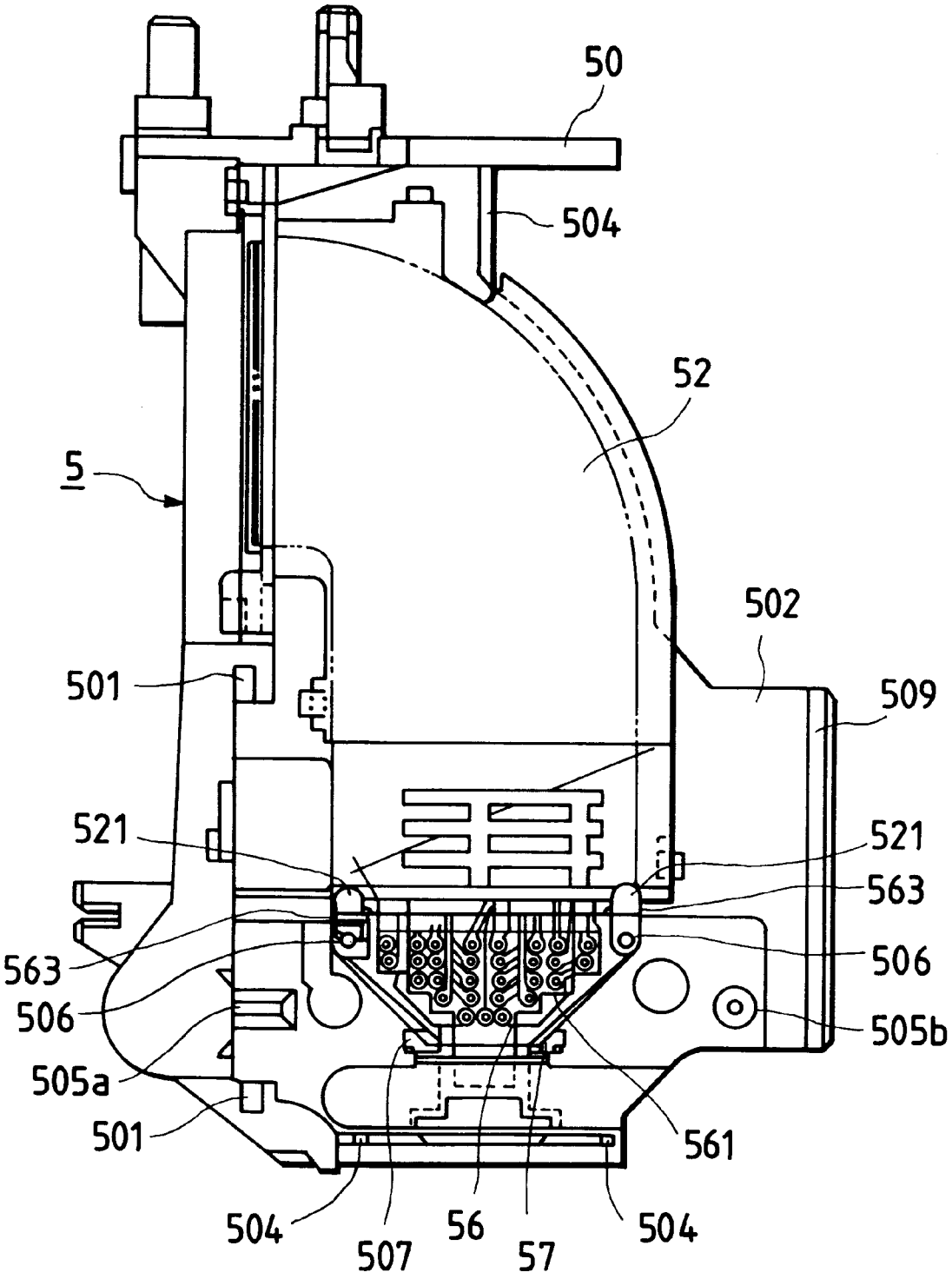
FIG. 6 is a structural drawing to show a contact part etc. of the carriage portion of the recording apparatus shown in FIG. 1.
Figure 7A:
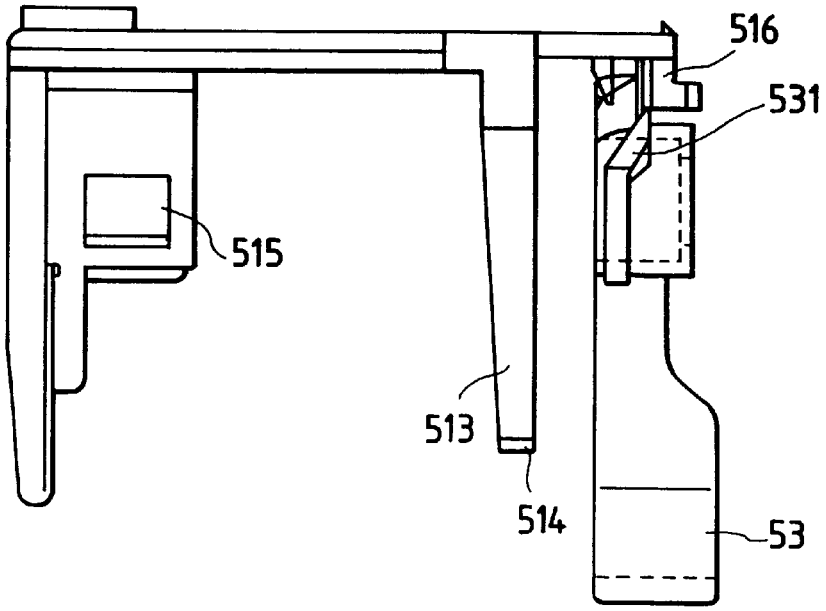
FIG. 7A and FIG. 7B are structural drawings to show the major part of a mounting/dismounting mechanism of the recording head in the carriage portion of the recording apparatus shown in FIG. 1.
Figure 7B:
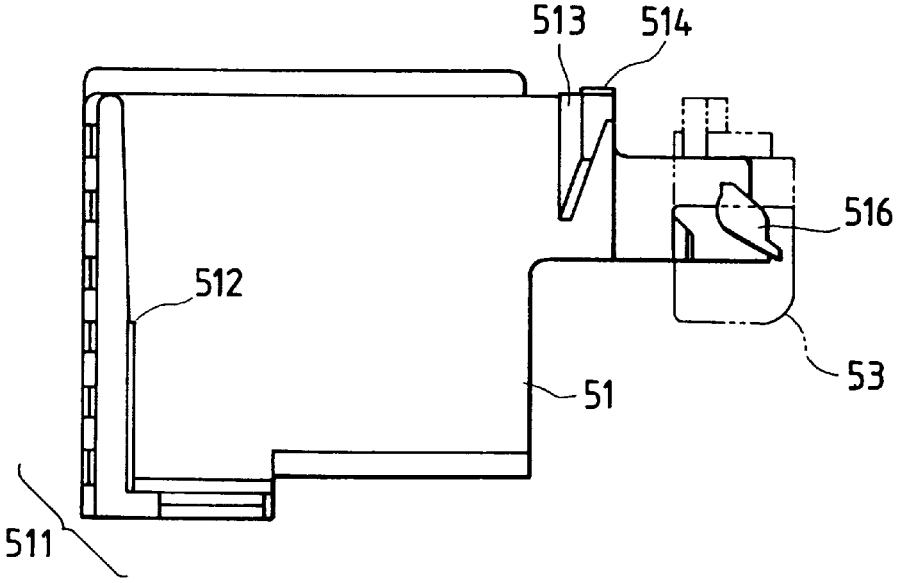
Figure 8A:
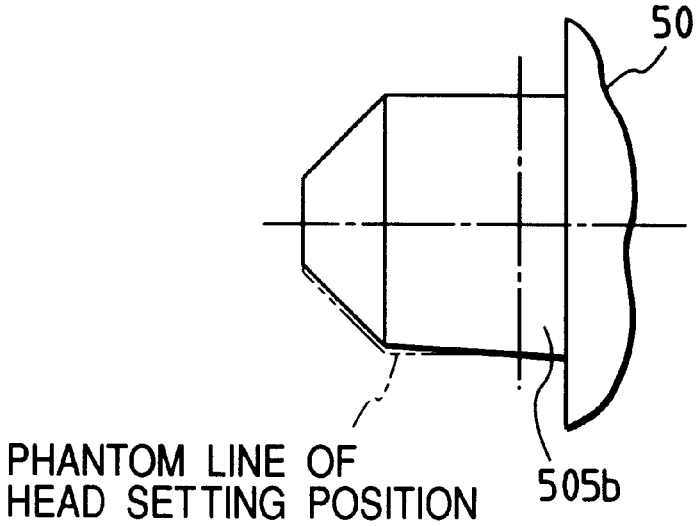
FIG. 8A and FIG. 8B are enlarged views of a fitting pin of the carriage portion shown in FIG. 6.
Figure 8B:
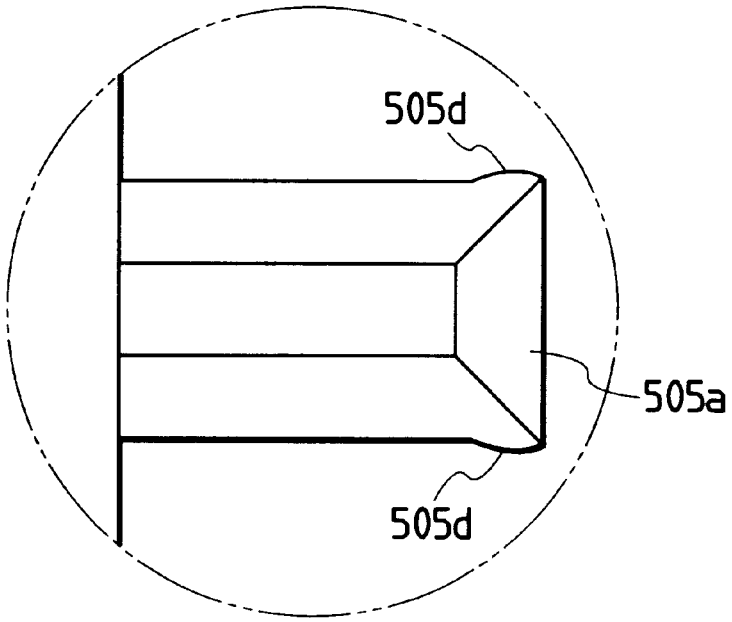

As shown in FIG. 6, the side plate 502 of the carriage 50 has two fitting pins 505*a*, 505*b* for positioning of the recording head 7, corresponding to fitting holes 77*a*, 77*b* (see FIG. 14D) of the base plate 72 of the recording head 7. The base plate 72 of the recording head 7 is inclined at the angle of about 1°-about 4° relative to the scan direction of the carriage portion 5 from driving of the recording head 7. For correspondence to the slant fitting holes 77*a*, 77*b*, one fitting hole 77*a* is made as a rectangular hole and the fitting pin 505*a* on the carriage 50 side corresponding thereto as a rectangular pin having a partially cylindrical shape 505*d*, as shown in FIG. 8B. Further, the other fitting hole 77*b* is made as a circular hole and the fitting pin 505*b* on the carriage side corresponding thereto is formed in a shape as shown in FIG. 8A in which the undercut portion in terms of the mold structure of the carriage 50 is removed so as to achieve fitting at the butt position (head set position) of the recording head 7 against the positioning surfaces 504 of the carriage 50. This can achieve accurate and smooth positioning of the recording head 7 even with the inclined base plate 72, without a need for a complex mold structure.

Further, a rubber pad 57 made of an elastic material such as silicone rubber of rubber hardness 30°–50° is provided on the contact face 503 (FIGS. 4A and 4B) provided on the side plate 502 of the carriage 50, for achieving electrical contact with the recording head 7. The contact portion 561 of the flexible board 56 is located on the pad. The rubber pad 57 and flexible board 56 both are positioned by positioning pins 506 provided on the side plate 502 of the carriage 50. Slits 563 are formed on the opposite side to the contact portion 561 in the positioning portion of the flexible board 56 so that the contact portion 561 is prevented from being affected by deformation or the like caused by assembly of the flexible board 56.

Figure 9A:
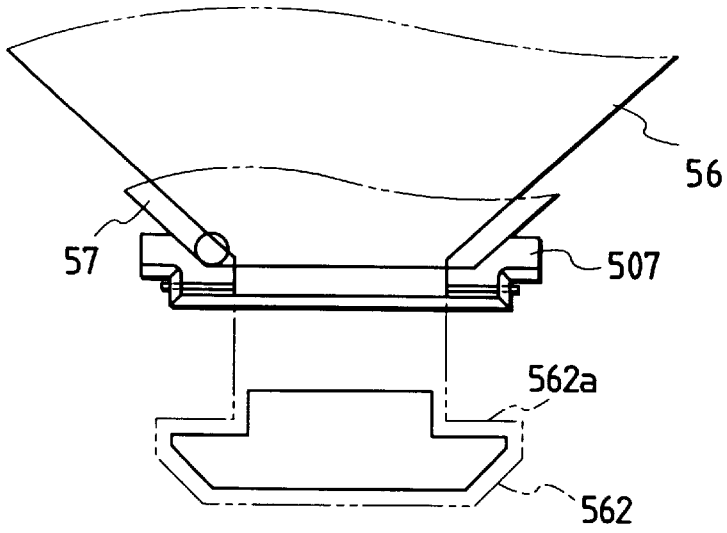
FIG. 9A, FIG. 9B, and FIG. 9C are drawings to explain assembling states of the tip portion of a flexible board of the carriage portion shown in FIG. 6.
Figure 9B:
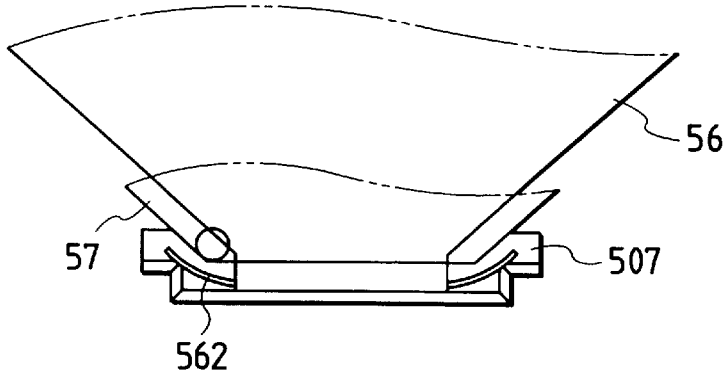
Figure 9C:
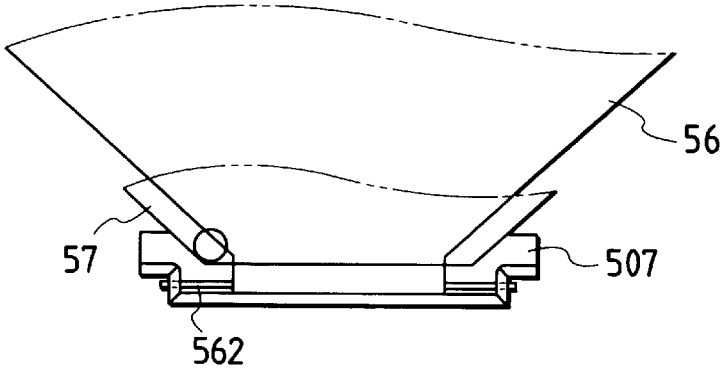

The contact portion 561 of the flexible board 56 becomes narrower at the tip portion 562 thereof so as to match the shape of the base plate 72 of the recording head 7 as shown in the enlarged views of FIGS. 9A–9C, and a hook portion 562*a* is provided at the tip. Forming of signal lines becomes easier by making the contact portion 561 in the triangular shape and decreasing the number of contact pads toward the tip as in this configuration. Further, the signal lines can be set in a high density by such a configuration. Further, the process becomes easier of the tip portion 562 of the flexible board 56.

The side plate 502 of the carriage 50 has a slit hole 507 in which the tip portion 562 of the flexible board 56 is put. When the tip portion 562 of the flexible board 56 is inserted into this slit hole 507, the tip portion 562 of the flexible board 56 is bent and guided into the slit hole 507 as shown in FIG. 9B. After the tip portion 562 passes the slit hole 507, this tip portion 562 becomes straight as shown in FIG. 9C. In this state the tip portion 562 is caught by the slit hole 507 to be prevented from slipping off. In this configuration, the tip portion 562 is free and the contact portion 561 of the flexible board 56 is not rigid, whereby it can be in good contact with the contact surface 78 (see FIG. 14D) of the recording head 7. When the recording head 7 is mounted, the contact surface 503 (see FIGS. 4A and 4B) of the carriage 50 goes into a notch portion 79 (see FIG. 14D) of the base plate 72 of the recording head 7, to become in contact with the contact surface 78 on a board formed inside the notch portion 79.

The flexible board 56 is routed along the side plate 502 of the carriage 50 and is bent vertically to be fixed to the carriage 50 by the base cover 52. In this case, the flexible board 56 is provided with a projection 563 for temporary fixation (see FIGS. 4A and 4B). Since the flexible board 56 can be fixed by fixing the projection 563 to the carriage 50, efficient assembly can be performed on the occasion of mounting of the base cover 52. Further, the base cover 52 is provided with stopper portions 521 in order to prevent the rubber pad 57 and flexible board 56 from slipping off from the pins 506 on the carriage 50.

The recording head 7 is provided with depressions 731 (see FIG. 14D) as clearances to accept projecting parts of the positioning pins 506 and the stopper portions 521 of the base cover 52. Accordingly, the length of the positioning pins 506 and the thickness of the stopper portions 521 of the base cover 52 can be increased by the extent of the depth, thereby realizing secure positioning and prevention of slip-off of the rubber pad 57 and flexible board 56. The flexible board 56 is fixed to the chassis 8 by flexible board fixing plate 85 (see FIG. 2) and changes its curvature according to the position of the carriage portion 5, whereby the flexible board 56 can transmit head driving signals from the electric board 9 to the recording head 7 in accordance with motion of the carriage portion 5.

The above configuration facilitates mounting or dismounting of the recording head 7 on or from the carriage portion 5, holding thereof, positioning thereof, the electrical contact thereof, and so on. For mounting the recording head 7, the hook lever 53 is moved up as shown in FIG. 4A, so that the head holder 51 is shifted to the left, thus getting ready for mounting of the recording head 7. In this state the recording head 7 is mounted and the hook lever 53 is rotated down, whereupon the head holder 51 moves together with the recording head 7 to the right as shown in FIG. 4B, thereby achieving the positioning, electrical contact, etc. of the recording head 7. In this state formation of image on the sheet medium P becomes possible. Further, for dismounting the recording head 7 from the carriage portion 5, the hook lever 53 is moved up, so that the head holder 51 is shifted to the left, whereupon the guide arm 513 of the head holder 51 presses the recording head 7 to the left. Then the recording head 7 is removed from the carriage portion 5.

A gap adjusting portion 58 for adjusting a gap between the recording head 7 and the platen 34 (see FIG. 1 to FIG. 3) according to the thickness of the recording sheet P is disposed in the upper part of the carriage 50. The gap adjusting portion 58 is composed of an adjusting lever 581, a press lever 582, a press spring 583, and a top cover 584, as shown in FIG. 5.

Figure 10:
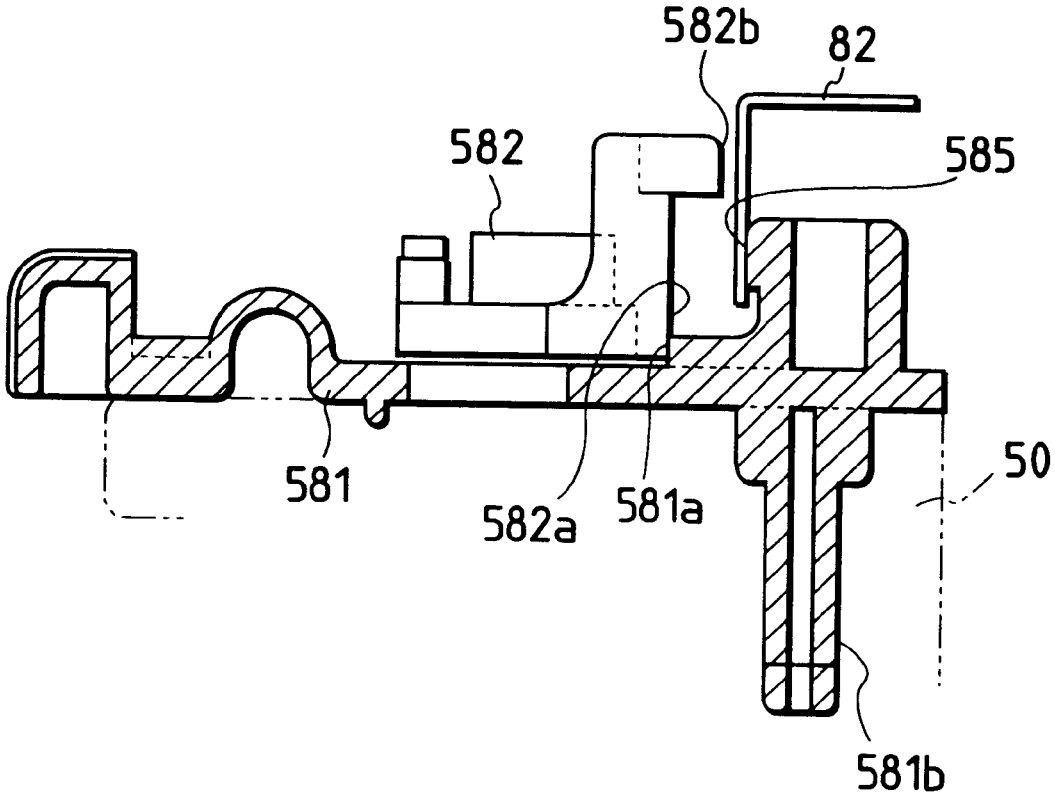
FIG. 10 is a cross-sectional side view of the positional relation of the adjusting lever and press lever in the gap adjusting portion shown in FIG. 5 with respect to the guide rail.

FIG. 10 is a cross-sectional side view of the positional relation of the adjusting lever 581 and press lever 582 relative to the guide rail 82. The gap adjusting portion 58 will be described in detail referring to FIG. 5 and FIG. 10.

The adjusting lever 581 has a pin 581*b* on the bottom surface and the pin 581*b* is put in a hole provided in the carriage 50 so as to be rotatable therein. The adjusting lever 581 further has slide faces 585 of a polygonal cylinder in different distances from the center O of rotation of the adjusting lever 581 according to the number of gap distance positions. The press lever 582 is rotatable about a pin provided on the carriage 50 and is energized by the press spring 583 so that the tip thereof opposed to the slide face 585 of the adjusting lever 581 is urged toward the slide face 585. The carriage 50 is rotatable about the guide shaft 81 and the slide face 585 is arranged to contact the guide rail 82 by the weight of the carriage 50. Accordingly, the slide face 585 of the adjusting lever 581 serves as a positioning portion in the direction of rotation of the carriage 50.

Provided at the root of the slide faces 585 of the adjusting lever 581 is a stopper portion 581*a* distances of which from the respective positions of the slide faces 585 are equal. Namely, in FIG. 5, distances A, B, C all are equal between the slide faces 585 and end faces of the stopper portion 581*a* at the respective positions of the slide faces 585. Corresponding thereto, a contact portion 582*a* for contact with the stopper portion 581*a* is provided at the bottom end of the press lever 582. In the range of the recording scan of the carriage 50 the contact portion 582*a* is in contact with the stopper portion 581*a* and a guide face 582*b* of the press lever 582 has a gap G of about 0.3 mm to 1 mm relative to the guide rail 82. The guide face 582*b* of the press lever 582 is located at a position about 3 mm to 10 mm shifted in the direction perpendicular to the scan direction of the carriage 50 with respect to the slide face 585 of the adjusting lever 581. In the present embodiment, as shown in FIG. 10, the slide face 585 of the adjusting lever 581 is in contact with the lower part of the guide rail 82 and the guide face of the press lever 582 is located beside the upper part of the guide rail 82.

Figure 15:
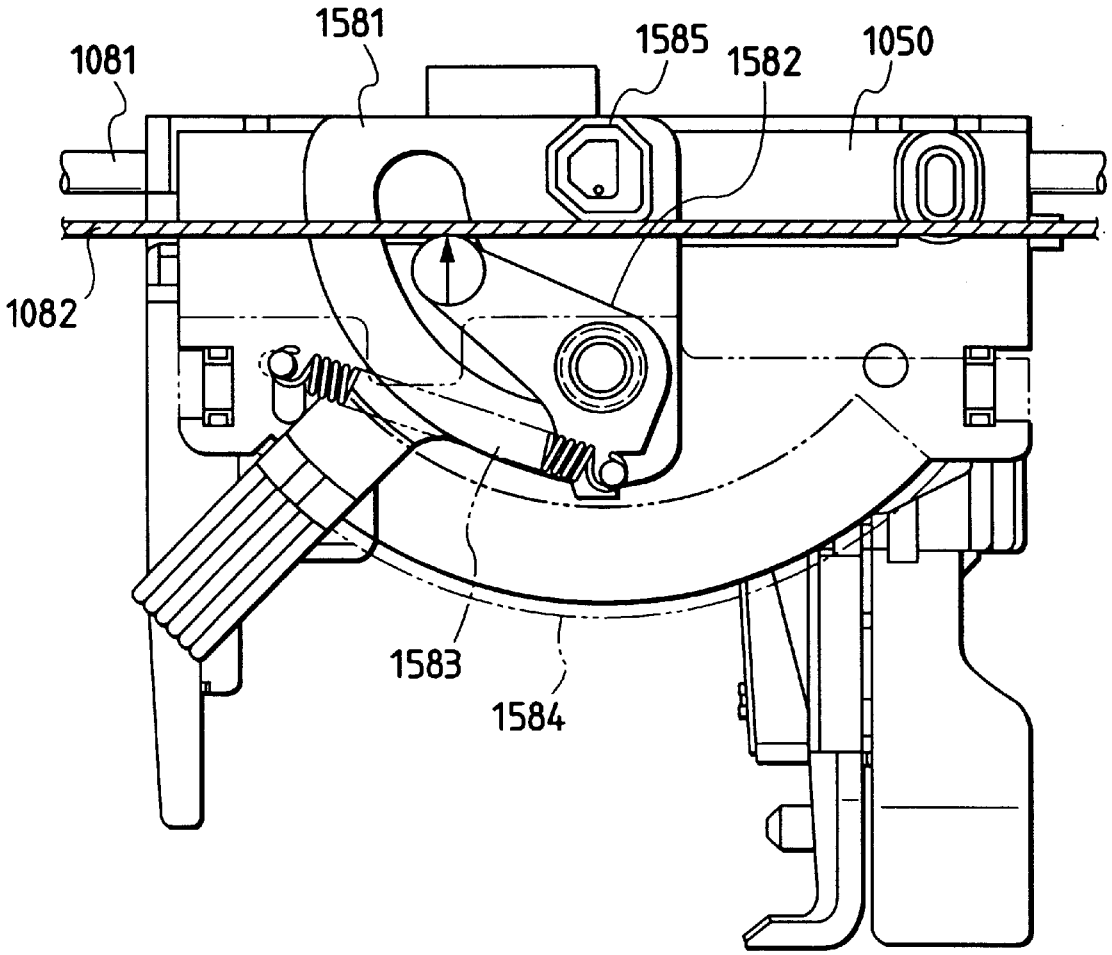
FIG. 15 is a plan view of the carriage portion of the conventional recording apparatus.

As described above, in the recording scan range of the carriage 5 the slide face 585 of the adjusting lever 581 is kept in contact with the guide rail 82 by the weight of the carriage 50 and recording head 7, whereby the carriage 50 is positioned. In addition, the contact portion 582*a* of the press lever 582 is in contact with the stopper portion 581*a* of the adjusting lever 581, so that the pressing force of the press lever 582 does not act on the guide rail 82. Accordingly, the slide load of the carriage 50 can be set in a small range and the torque to twist the carriage 50 (the force to rotate the carriage in the direction of the arrow and about the center of rotation located at the contact portion between the guide 1081 and the slide face 1585 in FIG. 15) does not act on the carriage 50, thereby achieving the smooth scanning of carriage. Since the slide load of the carriage 50 is decreased, the durability is also enhanced of the mechanism concerning the reciprocal scanning of the carriage 50. Further, because of the small load torque, the carriage 50 can be driven at high speed and the size and cost of the carriage motor etc. can be decreased.

Figure 11:
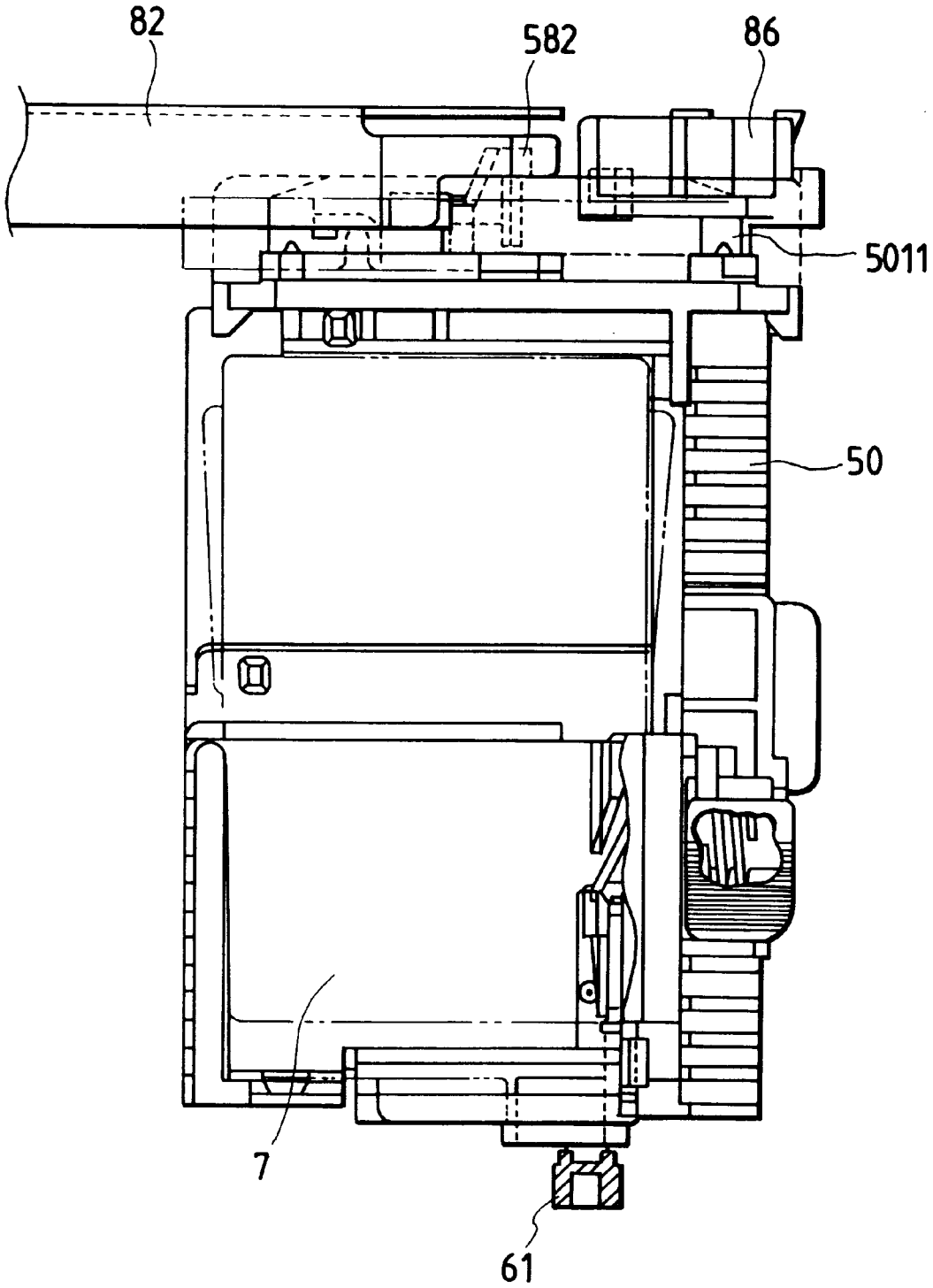
FIG. 11 is a front view of the carriage at a recovery process position.

On the other hand, when the ejection recovery process of the recording head 7 is carried out, the carriage 50 is moved to the position (the recovery process position) opposite to the recovery process portion 6 (see FIG. 1). The recovery process portion 6 is located outside the recording scan range and at one end of the overall scan range. The status of the carriage 50 at the recovery process position will be described referring to FIG. 11 and FIGS. 12A, 12B. FIG. 11 is a front view of the carriage at the recovery process position and FIGS. 12A and 12B are a plan view of the carriage at the recovery process position and a view to explain motion of a cam shaft, respectively.

Figure 12A:
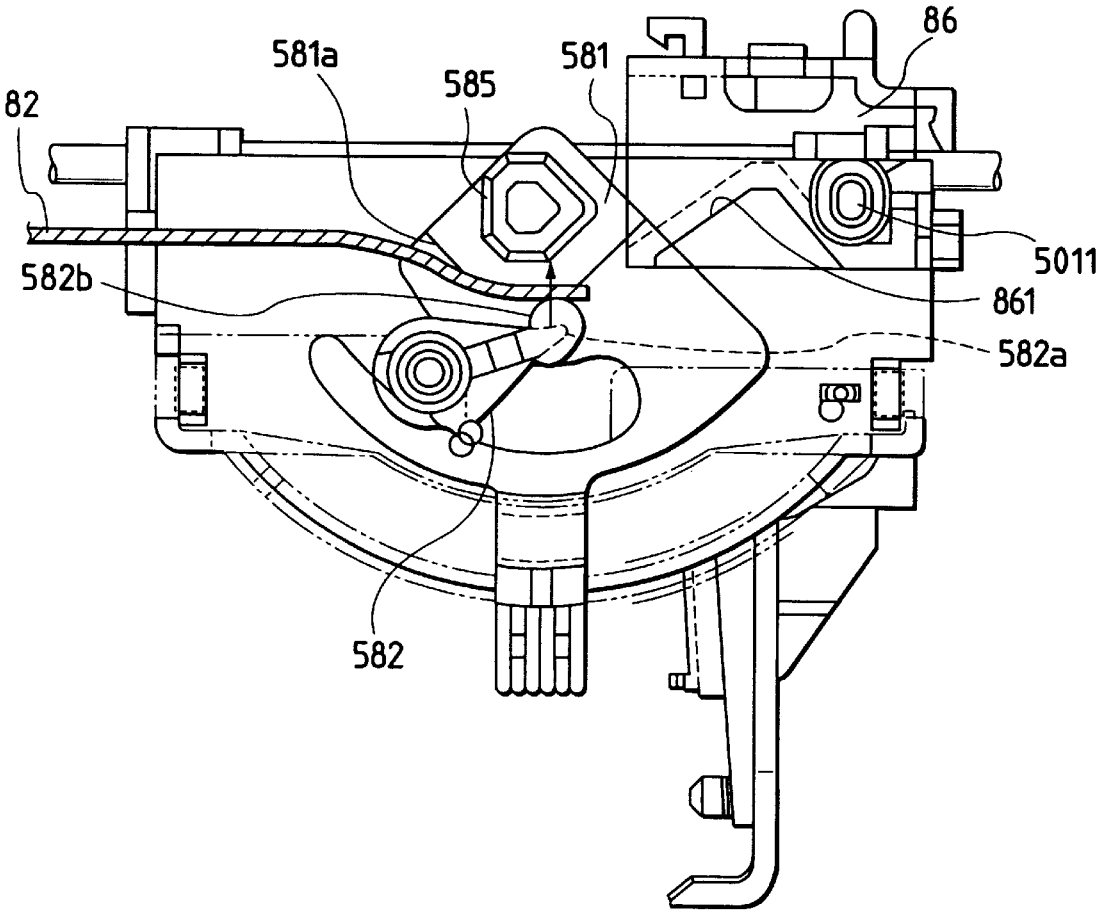
FIG. 12A and FIG. 12B are a plan view of the carriage at the recovery process position and a drawing to explain motion of a cam shaft, respectively.
Figure 12B:
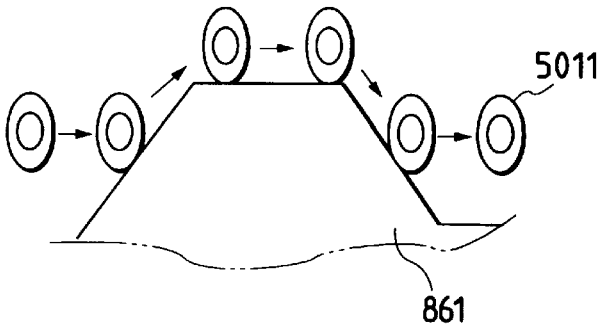

As shown in FIG. 11 and FIGS. 12A, 12B, the guide rail 82 is bent at one end thereof on the recovery process section 6 (see FIG. 1) side to this side (toward the press lever 582) and in the bent portion a portion opposite to the slide face 585 of the adjusting lever 581 is cut out. Provided on an extension of the guide rail 82 is a cap guide 86 (also shown in FIG. 1 and FIG. 2) in which a mountain-shaped cam portion 861 is formed. A cam shaft 5011 to engage the cam portion 861 of the cap guide 86 is provided on the top face of the carriage 50.

As the carriage 50 moves to the recovery process position, the guide rail 82 pushes the guide face 582*b* of the press lever 582 to rotate the press lever 582. This separates the contact portion 582*a* of the press lever 582 from the stopper portion 581*a* of the adjusting lever 581. At this position the slide face 585 of the adjusting lever 581 does not contact the guide rail 82, because the lower part of the guide rail 82 is cut out. Further, since the guide face 582*b* of the press lever 582 is urged against the guide rail 82 by the press spring 583, the recording head 7 mounted on the carriage can be rotated about the guide shaft 81 to go into contact with the cap 61 of the recovery process portion 6.

Specifically, when the carriage 50 moves to the recovery process position to bring the recording head 7 into contact with the cap 61, the cam shaft 5011 moves along the cam portion 861 as shown in FIG. 12B, so that the carriage 50 is rotated once in the opposite direction to that at the time of contact with the cap about the guide shaft 81 so as to be displaced upward and thereafter the carriage 50 is rotated from the up position to the down position toward the cap 61 this time, thereby achieving the contact between the recording head 7 and the cap 61. At this time the portions except for the guide face 582*b* of the press lever 582 do not contact the guide rail 82, because the lower part of the guide rail 82 (the portion of the guide rail that should contact the slide face) is cut out. As a result, the urging force by the press lever 582 surely acts on the guide rail 82, whereby the carriage 50 generates the contact pressure of the recording head 7 to the cap 61.

When one slide face 585 of the adjusting lever 581 is switched to another, the carriage 50 rotates about the guide shaft 81, thereby changing the gap distance for a sheet. The top cover 584 is fixed by the claws on the both sides of the carriage 50, thereby holding the adjusting lever 581, press lever 582, and so on. Further, the lever tip portion of the adjusting lever 581 has elasticity, and a projection formed on the bottom surface thereof is fitted in one of grooves 586 (see FIGS. 4A and 4B) formed in the top cover 584 according to the gap distance positions, so as to fix the adjusting lever 581 and form a sheet gap of a predetermined distance.

Second Embodiment

Figure 13:
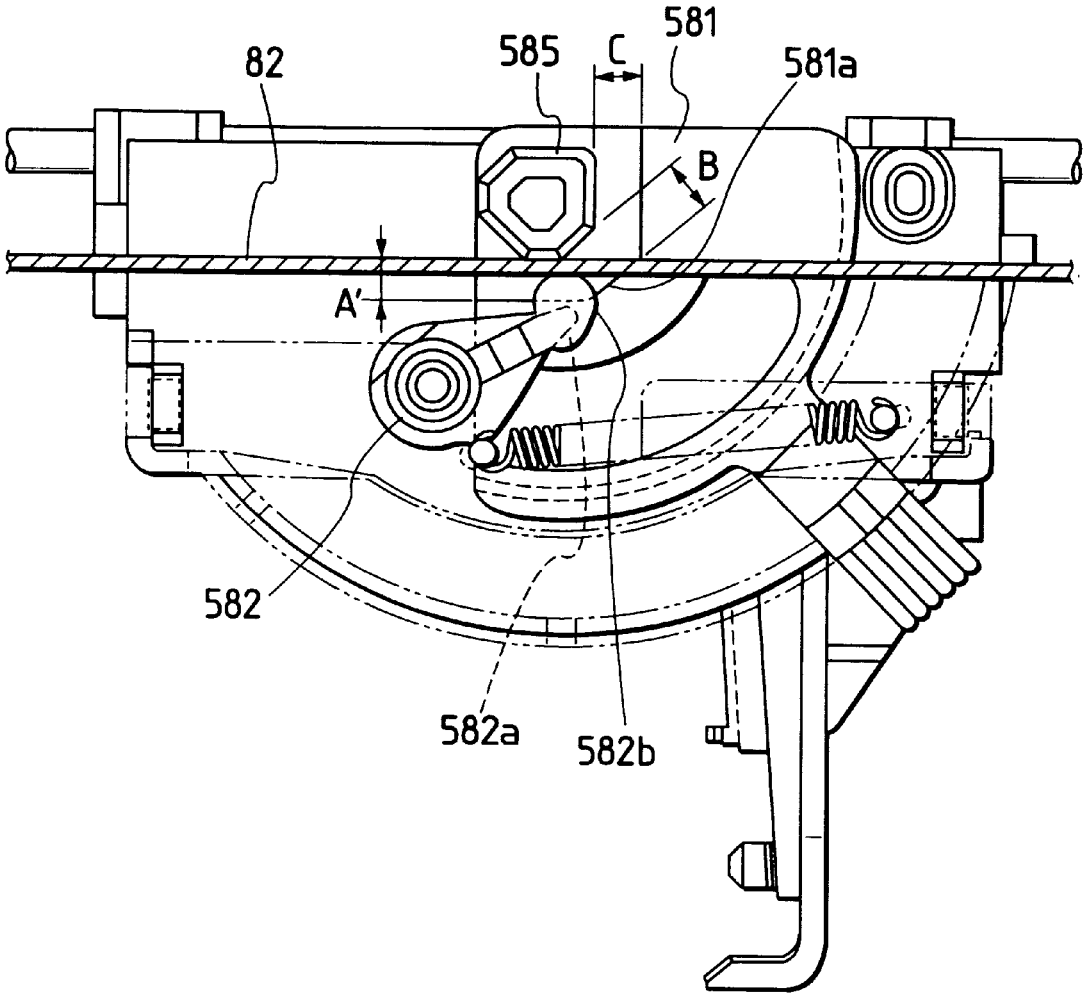
FIG. 13 is a plan view of the carriage portion in the second embodiment of the recording apparatus as an embodiment according to the present invention.

The first embodiment has the configuration wherein the press lever 582 always has the gap G relative to the guide rail 82 during the recording scan, but the press lever 582 may be arranged to be urged against the guide rail 82 depending upon the position of the adjusting lever 581, as shown in FIG. 13.

The stopper portion 581*a* is formed at the root of the slide faces 585 of the adjusting lever 581. The end faces of the stopper portion 581*a* are formed so that distances B, C of their opposed portion to the contact portion 582*a* of the press lever 582 with respect to the slide face 581*a* where the tip portion of the adjusting lever 581 is located at the central position and at the left end in the drawing, are the same as in the first embodiment, and the guide face 582*b* of the press lever 582 has the gap of 0.3 mm-1 mm to the guide rail 82. On the other hand, when the tip portion of the adjusting lever 581 is located at the right end as illustrated, the distance A' of the opposed portion to the contact portion 582*a* of the press lever 581 with respect to the slide face 582 is smaller by at least the length of the above gap than the above distances B, C. Therefore, when the adjusting lever 581 is located at this position, the contact portion 582*a* of the press lever 582 does not contact the stopper portion 581*a* of the adjusting lever 581, so that the press lever 582 is urged against the guide rail 82 even during the recording scan. The other structure is the same as in the first embodiment and the description thereof is thus omitted herein.

For example, when a lightweight recording head is mounted on the carriage 50, utilization of only the weight of the carriage 50 and the recording head will result in unstable positioning of the carriage 50 to the guide rail 82 during the recording scan. The present embodiment thus employs the structure for exerting the urging force of the press lever 582 on the guide rail depending upon the position of the adjusting lever 581, so that the urging force of the press lever 582 acts on the guide rail 82 in the case of the lightweight recording head, thus achieving stable positioning of the carriage 50 to the guide rail 82 during the print scan. In this case, the slide load of the carriage 50 becomes greater than in the case of the first embodiment, but the increase of the slide load is not so large, because this is applied to the lightweight recording head.

As described above, the recording apparatus of the embodiments is constructed so that the press member provided in the carriage is not pressed against the guide means in the region except for the predetermined region in the reciprocal scan region of the carriage; therefore, the smooth carriage scanning can be achieved, the recording accuracy can be enhanced for improvement in the quality of image, including the decrease in the diameter of dots, the increase in gradation levels, and so on, and the durability can also be improved. On the other hand, the press member is pressed against the guide means in the predetermined region in the reciprocal scan region of the carriage, so that the carriage can be displaced relative to the guide means by this urging force. This permits the ink jet recording apparatus having the recovery process portion in the predetermined region to obtain the sufficient urging force for covering the recording head by the cap means. Further, since the load is small during the reciprocal scanning of the carriage, the speed of driving of the carriage can be increased and the size of the driving means of the carriage can be decreased.

When the apparatus further has the second guide means for guiding the reciprocal scanning of the carriage and when the apparatus is arranged so that the carriage is rotatable about the second guide means and so that the positioning means is kept in contact with the guide means by the weight of the carriage and the recording head, the positioning of the carriage to the guide means can be realized by the simple structure. By employing the structure in which the guide means is the plate-shaped rail and the second guide means is the shaft, the structure of the apparatus can be made simple and compact.

Further, by employing the structure in which the apparatus has the restraining means for making the gap between the positioning member and the press member larger than the thickness of the guide means in their opposing direction and in which the guide means has the bent configuration toward the press member at one end thereof, the invention can easily realize the above-stated structure of the press member that is not urged against the guide means in the range except for the one end of the reciprocal scan range of the carriage but is urged against the guide means at the one end.

In this case, the positioning member and the press member are located so as to contact the guide means at mutually different positions in the direction perpendicular to their opposing direction and to the reciprocal scan direction of the carriage and the guide means corresponding to the predetermined region in the moving region of the carriage is cut out in the portion that would contact the positioning member otherwise; whereby the urging force of the press member surely acts on the guide means when the recording head is capped, thus achieving good capping.

Further, the positioning member is rotatably supported on the carriage and the positioning member has the plural slide faces in the different distances from the center of rotation, the slide faces being arranged to contact the guide member according to the position in the direction of rotation of the positioning member; whereby the position of the recording head can be changed depending upon the thickness of the recording medium. In this case, when the restraining means is constructed of the surface in contact with the portion different from the portion of the press member in contact with the guide means, the surface being positioned so that the distances from the respective slide faces are equal, fine control of gap becomes possible between the guide means and the press member. Further, if the mentioned surface is formed so as not to contact the press member while an arbitrary slide face out of the slide faces is in contact with the guide means, the stable positioning of the carriage to the guide means can be achieved for recording heads of different weights during the recording scan.

What is claimed is:

1. A recording apparatus for recording on a recording medium by using a recording head, said apparatus comprising:

a carriage for reciprocally scanning said recording head for recording on the recording medium;

guide means for guiding said carriage in a reciprocal scanning direction;

a positioning member provided on said carriage; and a press member provided on said carriage so that said press member is opposed to said positioning member through said guide means and pressing said guide means at a predetermined area in a reciprocally scanning area of said carriage, said press member releasing the pressing of said guide means at said reciprocally scanning area except of said predetermined area.

2. The recording apparatus according to claim 1, said recording apparatus further having second guide means for supporting said carriage in cooperation with said guide means to guide said carriage in said directions of the reciprocal scanning, wherein said carriage is rotatable about said second guide means.

3. The recording apparatus according to claim 2, wherein said positioning member is kept in contact with said guide means by the weight of said carriage and said recording head.

4. The recording apparatus according to claim 2, wherein said guide means is a plate-shaped rail and said second guide means is a shaft.

5. The recording apparatus according to claim 1, said recording apparatus further having restraining means for making a gap between said positioning member and said press member larger than a thickness of said guide means in an opposing direction of said positioning member and said press member, wherein said guide means is bent toward said press member at one end thereof.

6. The recording apparatus according to claim 5, wherein said positioning member and said press member are located so as to contact said guide means at different positions in a direction perpendicular to the directions of the reciprocal scanning of said carriage and to the opposing direction of said positioning member and said press member and wherein said guide means is cut out at said one end thereof and in a portion that said positioning means would contact otherwise.

7. The recording apparatus according to claim 5, wherein said positioning member is rotatably supported on said carriage and has a plurality of slide faces of different distances from the center of rotation, said plurality of slide faces being arranged so that either one may go into contact with said guide means according to a position in a direction of rotation of said positioning member.

8. The recording apparatus according to claim 7, wherein said restraining means is comprised of a surface formed at a position where distances from said respective slide faces are equal, said surface being in contact with a portion of said press member different from a portion of said press member pressed against said guide means.

9. The recording apparatus according to claim 8, wherein said surface is formed at a position where said surface does not contact said press member when an arbitrary slide face out of said slide faces is in contact with said guide means.

10. The recording apparatus according to claim 1, wherein said recording head is an ink jet recording head for ejecting ink from an ink ejection outlet.

11. The recording apparatus according to claim 10, wherein cap means for covering said ink ejection outlet is provided in said predetermined region.

12. An ink jet recording apparatus for recording on a recording medium by using an ink jet recording head, said apparatus comprising:

a carriage for reciprocally scanning said ink jet recording head for recording on the recording medium;

first guide means for guiding said carriage in a reciprocal scanning direction;

second guide means for guiding and supporting with said first guide means said carriage in the reciprocal scanning direction, said second guide means rotatably supporting said carriage;

cap means provided at a predetermined area in said reciprocal scanning direction to cap said ink jet recording head;

a positioning member provided on said carriage; and a press member provided on said carriage so that said press member is opposed to said positioning member through said first guide means, rotating said carriage around said second guide means at said predetermined area and pressing said first guide means to contact said ink jet recording head with said cap means, said press member releasing the pressing of said first guide means at said reciprocally scanning area except said predetermined area.

13. The ink jet recording apparatus according to claim 12, wherein said recording head is an ink jet recording head for ejecting ink from an ink ejection outlet by use of heat generated by a heater.

14. A recording apparatus for recording on a recording medium by using a recording head, said apparatus comprising:

a carriage for reciprocally scanning said recording head for recording on the recording medium in a scanning area having a predetermined area;

guide means for guiding said carriage in a reciprocal scanning direction;

biasing means for generating a biasing force to displace said carriage with respect to said guide means;

non-contact maintaining means for maintaining a non-contact condition between said biasing means and said guide means out of the predetermined area in the scanning area of said carriage; and contact allowing means for allowing said guide means and said biasing means to be in contact with each other at the predetermined area in the scanning area of said carriage, said biasing means effecting the biasing force to said guide means to displace said carriage through said contact allowing means.

15. A recording apparatus according to claim 14, wherein said recording head is an ink jet recording head for discharging ink through an ink discharge port.

16. A recording apparatus according to claim 15, wherein the predetermined area is provided with cap means for covering said ink discharge port.

17. A recording apparatus according to claim 15, wherein said predetermined area is provided with cap means for covering said ink discharge port, said carriage being displaced upon a biasing force of said biasing means and in contact with said cap means.

18. A method for generating a cap pressure in an ink jet recording apparatus, said method comprising the steps of:

providing a carriage for reciprocally scanning an ink jet recording head for recording on the recording medium;

providing first guide means for guiding the carriage in a reciprocal scanning direction;

providing second guide means for guiding and supporting with the first guide means and the carriage in the reciprocal scanning direction, the second guide means rotatably supporting the carriage;

providing cap means at a predetermined area in a reciprocal scanning direction to cap the ink jet recording head; and providing a positioning member and a press member opposed to the carriage through the guide means, wherein the press member presses the first guide means at the predetermined area and releases pressing of the first guide means except at the predetermined area.

* * * * *